US006175330B1

(12) United States Patent
Reits

(10) Patent No.: US 6,175,330 B1
(45) Date of Patent: Jan. 16, 2001

(54) ARRAY ANTENNA AND METHOD FOR OPERATING AN ARRAY ANTENNA

(75) Inventor: Bernard Jozef Reits, Hengelo (NL)

(73) Assignee: Hollandse Signaalapparaten B.V., Hengelo (NL)

( * ) Notice: Under 35 U.S.C. 154(b), the term of this patent shall be extended for 0 days.

(21) Appl. No.: 09/448,147

(22) Filed: Nov. 24, 1999

(30) Foreign Application Priority Data

Nov. 26, 1998 (NL) ..... 1010657

(51) Int. Cl.[7] ..... H01Q 3/22
(52) U.S. Cl. ..... 342/371; 342/372
(58) Field of Search ..... 342/81, 157, 368, 342/372, 371

(56) References Cited

U.S. PATENT DOCUMENTS 4,626,859 * 12/1986 Stansfield ..... 342/442
5,010,343 * 4/1991 Andersson ..... 342/432
5,038,149 * 8/1991 Aubry et al. ..... 342/372
5,122,808 * 6/1992 Kyriakos ..... 342/442
5,767,805 * 6/1998 Aubry ..... 342/372

FOREIGN PATENT DOCUMENTS

0207511 * 1/1987 (EP) .

* cited by examiner

*Primary Examiner*—Thomas H. Tarcza
*Assistant Examiner*—Dao L. Phan
(74) *Attorney, Agent, or Firm*—Oblon, Spivak, McClelland, Maier & Neustadt

(57) ABSTRACT

Array antenna of the monopulse type for realizing, on the basis of at least two groups of radiators, of at least two receiving beams for obtaining a difference signal. According to the invention, the at least two groups are homogeneously distributed within the antenna volume. In a transmit mode, the radiators are steered collectively, in a receive mode, the radiators are combined per group.

10 Claims, 1 Drawing Sheet

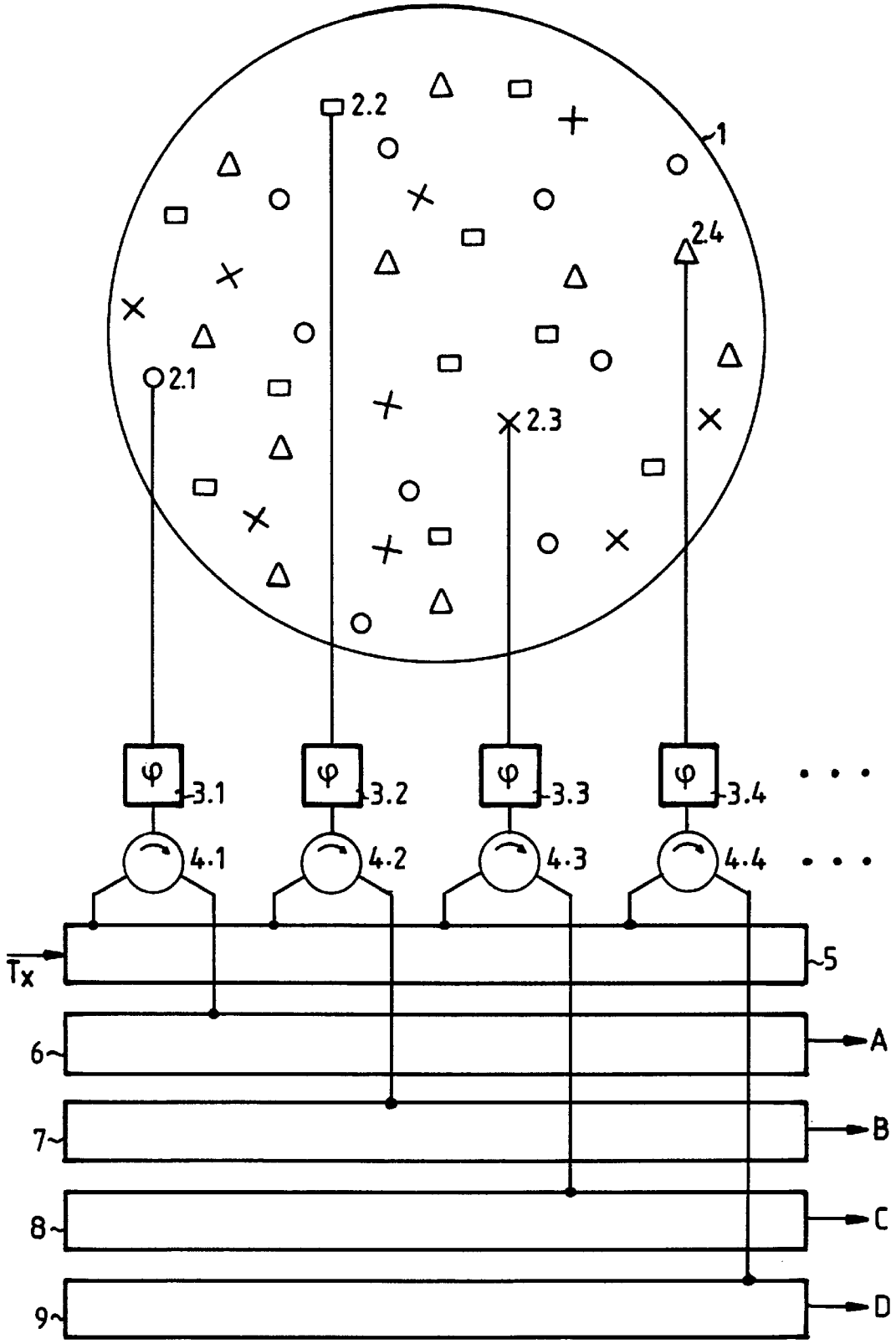
1
2.1
2.2
2.3
2.4
φ
3.1
3.2
3.3
3.4
4.1
4.2
4.3
4.4
Tx
5
6
7
8
9
A
B
C
D

ARRAY ANTENNA AND METHOD FOR OPERATING AN ARRAY ANTENNA

BACKGROUND OF THE INVENTION

1. Field of the Invention

The invention relates to an array antenna, comprising a set of radiators for the transmission or reception of microwave radiation, which radiators are distributed at least substantially homogeneously within the volume of an imaginary three-dimensional body, preferably spherical in shape, where each individual radiator is via an adjustable phase shifter connected to a transmitting network to choose a direction in which microwave radiation can be transmitted.

2. Discussion of the Background

An array antenna of this type is known from DE-A 28.22.845. For fire-control applications, however, this known array antenna is unsuitable for determining the position of a target with sufficient accuracy. For an accurate determination, it is required to generate for a target the error voltages known in the art, for instance in azimuth and elevation, for instance under the application of a monopulse antenna.

An array antenna of the monopulse type is known from patent specification EP-B 0.207.511. The spherical antenna disclosed in this specification is divided into eight octants by means of which the error voltages are determined by combining the output signals of the eight octants. The known array antenna is most satisfactory if a target is situated on an intersecting line of two dividing planes between the octants, because this would imply symmetry between the various antenna parts. For targets that do not fulfil this condition, the array antenna performance is suboptimal.

SUMMARY OF THE INVENTION

The array antenna according to the invention obviates this drawback and is characterized in that to enable reception, the set of radiators is divided into two, three or four subsets, that for each subset the radiators are distributed at least substantially homogeneously within the body and that there are provided two, three or four receiving networks connected to the subsets for simultaneously choosing two, three or four directions from which microwave radiation can be received.

The invention additionally relates to a method for operating an array antenna, comprising a set of radiators for the transmission or reception of microwave radiation, which radiators are distributed at least substantially homogeneously within the volume of an imaginary three-dimensional body, preferably spherical in shape, whereby in a transmit mode, a transmitter signal is applied, via adjustable phase shifters and a transmitting network, to at least substantially all radiators for generating a microwave beam in a predetermined direction.

The inventive method is characterized in that in a receive mode, two, three or four subsets of at least substantially equal numbers of radiators are combined via adjustable phase shifters and two, three or four receiving networks for choosing two, three of four directions from which microwave radiation can be received.

A favourable realization of the method is characterized in that in the transmit mode, the microwave beam is directed at a target and that in the receive mode, the two, three or four directions are chosen such that the output signals of the two, three or four receiving networks can be combined to yield a sum signal and at least one difference signal.

BRIEF DESCRIPTION OF THE DRAWING

The FIGURE is a diagram of an array antenna, according to an embodiment of the present invention.

DETAILED DESCRIPTION OF THE PREFERRED EMBODIMENTS

The invention will now be explained in further detail with reference to the figure, which schematically represents how a set of radiators 2,*i* is homogeneously distributed within a sphere 1, at least such that, after steering the radiators in phase in a known manner, a beam with a favourable main lobe/side lobe ratio is obtained. According to the invention, the set of radiators is divided into four subsets, each of which is likewise homogeneously distributed within sphere 1. By way of illustration, the radiators of the different subsets are marked with circlets, squares, crosses and triangles. Via a bidirectional phase shifter 3,*i* and a circulator 4,*i*, each radiator 2,*i* is connected to a transmitting network 5 which distributes microwave energy supplied by a transmitter (not shown) over all radiators 2,*i*. The radiators 2,*i* of the four different subsets are via the corresponding circulators 4,*i* connected to four receiving networks 6,7,8,9, such that received microwave radiation can be transmitted combined as four signals A,B,C,D.

In a first operational mode, the phase shifters 3,*i* are in a known manner adjusted such that microwave energy supplied via transmitting network 5 is unidirectionally transmitted as a beam. Via phase shifters 3,*i*, received echo signals are coherently combined in a known manner to yield four mutually coherent echo signals at the outputs A,B,C,D which can subsequently be summed in order to obtain one echo signal.

In a second operational mode, the phase shifters 3,*i* can in a known manner be adjusted such that microwave energy supplied via transmitting network 5 is unidirectionally transmitted as a beam. After transmission, the phase shifters 3.*i* are readjusted such that the four subsets generate four different receiving beams, each of which makes a small angle with the transmitted beam. It would then make sense to position the beams such that a conventional monopulse measurement is performed so that the received echo signals can via the phase shifters 3.*i* be coherently combined to yield four monopulse output signals A,B,C,D which can subsequently be converted into sum and difference signals.

Another possibility is to realize the invention with merely two subsets of radiators 2,*i*, in which case an error voltage in azimuth or in elevation can fully analogously be determined from the signals A and B in a radar transmission. The even radar transmissions can then for instance be used to determine an error voltage in azimuth, the odd transmissions serving to determine an error voltage in elevation.

Yet another possibility is to realize the invention with three subsets of radiators 2,*i*; in this case three receiving beams are realized, one of which is for instance positioned above the transmission beam and two below the transmission beam, one to the left and one to the right, after which the error voltages in azimuth and elevation can in an obvious manner be determined from the signals A, B and C.

What is claimed as new and desired to be secured by Letters Patent of the United States:

1. An array antenna comprising a set of radiators configured to transmit and receive microwave radiation, the radiators being distributed substantially homogeneously within an imaginary three-dimensional body, each radiator is via an adjustable phase shifter connected to a transmitting network to choose a direction in which microwave radiation can be transmitted, wherein to enable reception, the set of radiators is divided into two, three or four subsets, for each subset the radiators being distributed substantially homogeneously within the body, two, three or four receiving networks being connected to the subsets for simultaneously choosing two, three or four directions from which the microwave radiation can be received.

2. A method for operating an array antenna, comprising;

selectively transmitting and receiving microwave radiation from a set of radiators, the radiators being distributed substantially homogeneously within an imaginary three-dimensional body;

applying a transmitter signal to the radiators via adjustable phase shifters and a transmitting network;

generating a microwave beam in a predetermined direction in response to applying step, wherein in a receive mode, two, three or four subsets of substantially equal numbers of radiators are combined via the adjustable phase shifters and two, three or four receiving networks for choosing two, three or four directions from which the microwave radiation can be received.

3. The method as in claim 2, wherein, in the transmit mode, the microwave beam is directed at a target and that in the receive mode, the two, three or four directions are chosen such that the output signals of the two, three or four receiving networks can be combined to yield a sum signal and at least one difference signal.

4. An array antenna, comprising:

a set of radiators configured to transmit and receive microwave radiation, the radiators being distributed substantially homogeneously within an imaginary three-dimensional body, the radiators being divided into a plurality of subsets of radiators;

a plurality of adjustable phase shifters correspondingly coupled to the subsets of radiators;

a transmitting network coupled to the adjustable phase shifters and configured to transmit the microwave radiation; and a plurality of receiving networks coupled to the adjustable phase shifters, the receiving networks corresponding to the subsets of radiators and being configured to receive the microwave radiation in a selected direction based upon the subsets of radiators, wherein output signals of the receiving networks are selectively combined to yield a sum signal and at least one difference signal.

5. The array antenna as in claim 4, wherein the body is spherical.

6. The array antenna as in claim 4, wherein the microwave radiation is unidirectionally transmitted as a beam by the transmitting network, the receiving networks receiving echo signals that are summed to produce a signal echo signal.

7. The array antenna as in claim 4, wherein the microwave radiation is unidirectionally transmitted as a beam by the transmitting network, and the adjustable phase shifters are adjusted to generate a plurality of receiving beams that are different from each other, each of the receiving beams forming a small angle with the transmitted beam.

8. The array antenna as in claim 1, wherein the microwave radiation is unidirectionally transmitted as a beam by the transmitting network, and the adjustable phase shifters are adjusted to generate a plurality of receiving beams that are different from each other, each of the receiving beams forming a small angle with the transmitted beam.

9. The array antenna as in claim 1, wherein the body is spherical.

10. The array antenna as in claim 1, wherein the microwave radiation is unidirectionally transmitted as a beam by the transmitting network, the receiving networks receiving echo signals that are summed to produce a signal echo signal.

* * * * *